US005426447A

United States Patent [19]

Lee

[11] Patent Number: 5,426,447

[45] Date of Patent: Jun. 20, 1995

[54] DATA DRIVING CIRCUIT FOR LCD DISPLAY

[75] Inventor: Sywe N. Lee, Taipei, Taiwan, Prov. of China

[73] Assignee: Yuen Foong Yu H.K. Co., Ltd., Hong Kong

[21] Appl. No.: 971,721

[22] Filed: Nov. 3, 1992

[51] Int. Cl.[6] ..... G09G 3/36

[52] U.S. Cl. ..... 345/103; 345/208; 345/94

[58] Field of Search ..... 345/92, 94, 90, 98, 345/100, 103, 87, 204, 206, 208

[56] References Cited

U.S. PATENT DOCUMENTS

| | | | |
|---|---|---|---|
| 4,231,035 | 10/1980 | Van Doorn et al. | 345/94 |
| 4,233,603 | 11/1980 | Castleberry | 345/84 |
| 4,403,217 | 9/1983 | Becker et al. | 345/206 |
| 4,779,085 | 10/1988 | Mizutome et al. | 345/92 |
| 4,789,223 | 12/1988 | Kasahara et al. | 345/87 |
| 4,818,991 | 4/1989 | Gay . | |
| 4,922,240 | 5/1980 | Duwaer | 345/100 |
| 4,931,787 | 6/1990 | Shannon | 345/93 |
| 4,963,860 | 10/1990 | Stewart | 345/206 |
| 5,061,920 | 10/1991 | Nelson | 345/98 |
| 5,113,181 | 5/1992 | Inoue et al. | 345/84 |
| 5,151,689 | 9/1992 | Kabuto et al. | 345/103 |
| 5,151,805 | 9/1992 | Takeda et al. | 345/94 |
| 5,159,325 | 10/1992 | Kuijk et al. | 345/84 |
| 5,170,155 | 12/1992 | Plus et al. | 345/100 |
| 5,206,633 | 4/1993 | Zalph | 345/92 |
| 5,250,931 | 10/1993 | Misawa et al. | 345/92 |

FOREIGN PATENT DOCUMENTS

| | | | |
|---|---|---|---|
| 0228317 | 7/1987 | European Pat. Off. . | |
| 0304990 | 3/1989 | European Pat. Off. . | |
| 0493820 | 7/1992 | European Pat. Off. | 345/92 |
| 2626705 | 8/1989 | France . | |
| 2089091 | 3/1990 | Japan | 345/94 |

*Primary Examiner*—Richard Hjerpe
*Assistant Examiner*—Lun-Yi Lao
*Attorney, Agent, or Firm*—Jones, Day, Reavis & Pogue

[57] ABSTRACT

A data driver circuit and system driving scheme that can be integrated directly onto an LCD display substrate to eliminate the cost of the peripheral integrated circuits and the hybrid assembly needed by unscanned active matrix liquid crystal displays to connect them to the array. A demultiplexer circuit is deposited on the display for demultiplexing a group of Y columns of multiplexed video data input signals to X groups of Y pixel capacitors that are also deposited on the substrate in Z rows. In addition, a precharging circuit is deposited on the substrate to precharge the pixel capacitors to a first voltage level such that the video data input signals coupled thereto in a demultiplexed fashion causes the pixels to discharge to a second predetermined voltage level to provide a video display as the rows of pixels are sequentially scanned.

15 Claims, 5 Drawing Sheets

DATA DRIVING CIRCUIT FOR LCD DISPLAY

BACKGROUND OF THE INVENTION

1) Field of the Invention

The present invention relates generally to video displays and their associated driving circuits and in particular to LCD video display column driving circuits that use a multiplexing arrangement to reduce the number of input video data lines and that also use data lines and pixel capacitors that are precharged prior to the application of the video data signals to enable selected ones to be discharged to an appropriate level by the incoming video data signals to enhance the operation of the display.

2) Description of Related Art

Matrix display devices commonly utilize a plurality of display elements that are arranged in a matrix of rows and columns and supported on opposing sides of a thin layer of electro-optic material. Switching devices are associated with the display elements to control the application of data signals thereto. The display elements include a pixel capacitor driven by a transistor as a switching device. One of the pixel electrodes is on one side of the matrix display and a common electrode for each of the pixels is formed on the opposite of the matrix display. The transistor is usually a thin-film transistor (TFT) that is deposited on a transparent substrate such as glass. The switching element transistor has its source electrode connected to the pixel electrode that is deposited on the glass on the same side of the display matrix as the switching transistor. The drain electrodes of all of the switching transistors in a given column are connected to the same column conductor to which data signals are applied. The gate electrodes of all of the switching transistors in a given row are connected to a common row conductor to which row selection signals are applied to switch all the transistors in a selected row to the ON condition or state. By scanning the row conductors with the row selection signals, all of the switching transistors in a given row are turned ON and all of the rows are selected in a sequential fashion. At the same time, video data signals are applied to the column conductors in synchronism with the selection of each row. When the switching transistors in a given row are selected by the row select signal, the video data signals supplied to the switching transistor electrodes cause the pixel capacitors to be charged to a value corresponding to the data signal on the column conductor. Thus each pixel with its electrodes on opposite sides of the display acts as a capacitor. When the signal for a selected row is removed, the charge in the pixel capacitor is stored until the next repetition when that row is again selected with a row select signal and new voltages are stored therein. Thus a picture is formed on the matrix display by the charges stored in the pixel capacitors.

It is to be understood that the use of the term "video" herein, although it has been generally applied to the use of signals for television, is intended to cover displays other than TV pictures or displays. Such displays may be hand-held games having an LCD display with moving figures thereon and the like.

The resolution of the picture that is developed depends upon the number of pixels forming the image. It is common in a commercially available black and white active matrix liquid crystal display that is unscanned to have a display with 1024 columns and 768 rows. Such display requires 1792 row and column driver leads.

It is clear that the greater the number of pixels in a matrix, the more difficult it is to couple the many required column and row drive lines to the display. Thus a number of devices have been developed in an effort to reduce the number of connections required between the circuits external to the matrix and the circuitry deposited on the matrix itself. U.S. Pat. No. 4,922,240 discloses a proposal to integrate the scanner electronics on the display substrate using the same technology used in the manufacture of the pixel drivers for the LCD elements. It further proposed to reduce the number of connections to the matrix by using a commutator or switch configuration based on the same matrix configuration used in the active display to select an individual pixel. Operation for use as a TV display is not described.

U.S. Pat. No. 5,151,689 discloses a display device having a reduced number of column signal lines by using a switching arrangement that connects at least two display elements to a signal line in each row and sequentially scanning each row so that the display signal is time serially applied through the same signal line to each of at least two display elements connected to that signal line. Thus the total number of signal lines can be reduced to a value equal to or smaller than the number of display elements in the row direction.

U.S. Pat. No. 4,931,787 proposes to reduce the number of address conductors by arranging the picture elements in groups of at least two picture elements with the picture elements of each group being addressed with the same switching signal and data conductors. The switching transistors associated with the pixel elements of each group are operable at respective different voltage levels of the switching signal. Therefore, by using switching signals obtained from the driving means whose voltage levels change in predetermined manner over a selected amplitude range, the switching transistors associated with the picture elements of each group can be selectively controlled. In this way, one conductor can have several different voltages applied thereto which will operate a like number of pixels.

Other than these known examples, almost all of the commercially available active matrix liquid crystal displays are unscanned. Such unscanned display requires one external lead for each column and row line. As stated earlier, a direct line interface driver for a black and white 768×1024 computer display would require 1792 leads. Dealing with this many leads in the display drivers is an enormous problem as indicated earlier. It is a problem that will get worse as the resolution and complexity of the displays increase. Two major goals for solving the problem are to reduce the number of required input leads and to integrate the driver circuitry consisting of shift registers, latches and drivers directly onto the display substrate. This would reduce costs and increase reliability by eliminating the need for mounting integrated circuits on a separate substrate.

SUMMARY OF THE INVENTION

The present invention is directed to a new data driver circuit and a new driving scheme that can be integrated directly onto the display substrate. This will eliminate the cost of the peripheral integrated circuits and the hybrid assembly needed by unscanned active matrix liquid crystal displays to connect them to the array. Thus in the present invention, using a 384×240 pixel color hand-held TV as an example, a demultiplexer and a precharge circuit are fabricated with thin-film transistors (TFTs) on the display itself to transfer video data and to interface the display directly to a video source. The video signals from a video source not on the display are arranged in a multiplexed fashion to come onto the display through input data leads using one-sixth of a designated line time interval. As indicated, this is an example only and for other displays using other numbers of input leads, a different ratio could be used. Control signals enable the first block of demultiplexing circuitry to transfer the video signals to the first group of the display's internal data lines. After the completion of the first data transfer to the first group of vertical lines or columns, the second group of video signals will be transferred to the second group of internal data lines during the second one-sixth of the designated line time interval. This is done by enabling the control signals of a second demultiplexing circuit. This operation continues sequentially for demultiplexing circuits 1–6 in the example used or 1—N in the other displays with a different number of columns.

Thus the entire row of video information is transferred to the internal data lines by demultiplexing video signals to X groups of Y switching elements in a selected one of Z rows during an allocated data input time, t. The advantage of this new demultiplexing driving scheme is to reduce the number of external lead connections from 384, in the example given, to 79, including 64 input data lines and the necessary control and clock signals, and significantly solve the TFT LCDs assembly and packaging problems of the small connector pitch. As a result, it reduces the manufacturing cost.

In addition to the demultiplexing scheme, a precharge circuit is used for each data line. These circuits are used to simultaneously precharge their associated pixel capacitors to either a high or low preselected voltage level so that it requires only the discharge of the data line and the pixel capacitor to the required level during the allocated data signal input time interval, t. Only two transistors are used on each data line, one for the input signal demultiplexing and one for precharging of the internal data lines. Therefore, the matrix is easy to manufacture with good yield.

Thus, it is a major feature of the present invention to fabricate an LCD display having a demultiplexer circuit and a precharge circuit deposited on the display itself using thin-film transistors.

It is still another important feature of the present invention to provide a novel data driver circuit for a self-scanned TFTLCD device which has a precharge transistor for each data line that precharges all data lines and pixel capacitors in a selected row to a predetermined voltage level so that it requires discharge of the data lines and the pixel capacitors to the required level during the data signal input time interval, thus requiring less time than charging the pixel capacitors and the data lines.

It is also a feature of the present invention to utilize only one demultiplexing transistor and one precharging transistor for each data line thereby enabling a good yield during manufacture.

BRIEF DESCRIPTION OF THE DRAWINGS

These and other features of the present invention will be more fully disclosed in the following detailed description of the drawings in which like numerals represent like elements and in which.

DETAILED DESCRIPTION OF THE DRAWINGS

Figure 1:
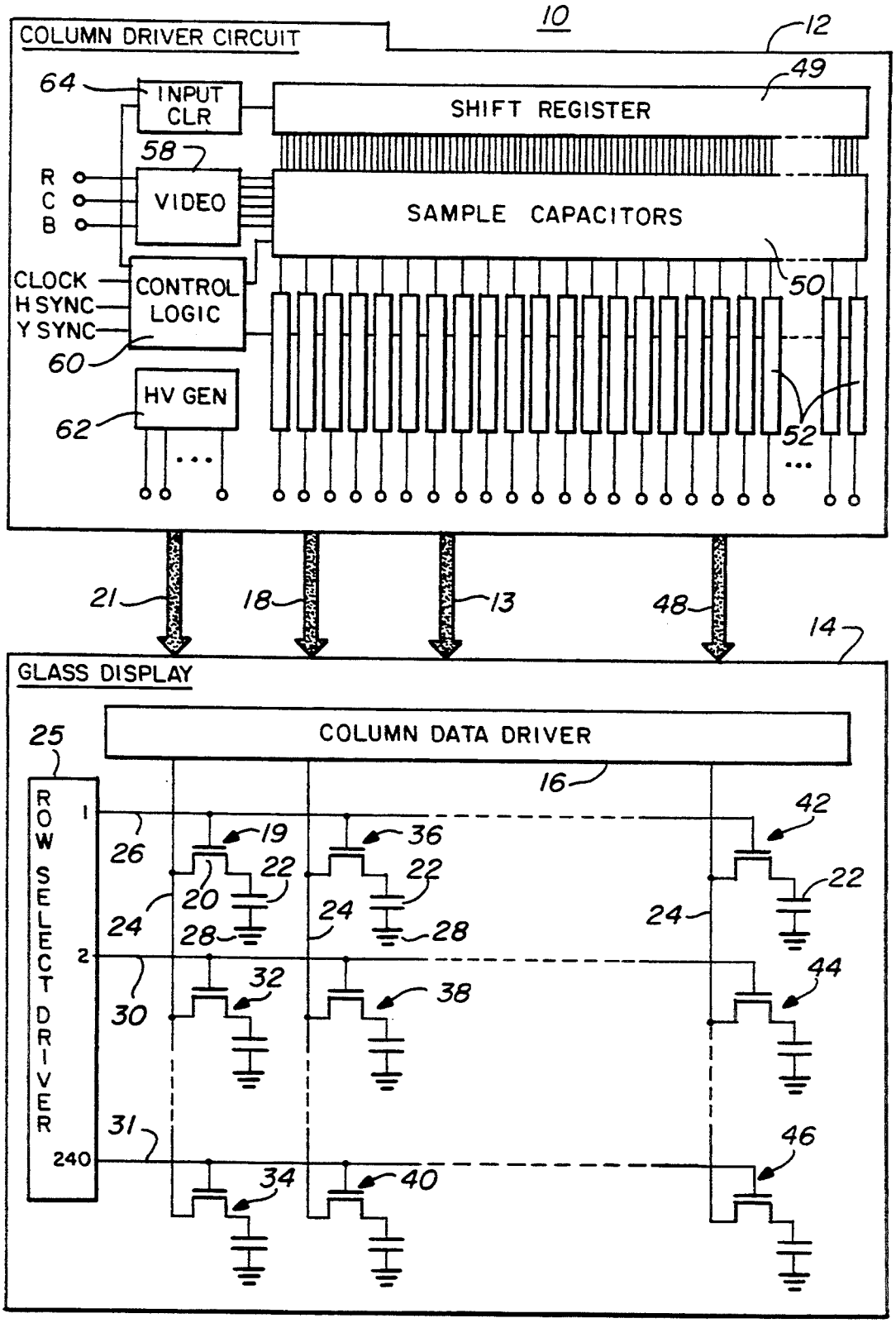
FIG. 1 is a basic block diagram of the novel system and data driver circuit for a self-scanned TFTLCD video display.

FIG. 1 is a basic block diagram of the novel display system 10 which includes the display device 14 and the "off-glass" control circuits 12 that are separate from and connected to the display 14 to drive the elements thereon. An active matrix liquid crystal display (AMLCD) of the type illustrated in FIG. 1 may typically consist of 200,000 or more display elements. Clearly, for displaying television pictures, the greater the number of display elements, the greater the resolution of the picture. For a hand-held TV, for example, the array may include 384 columns and 240 rows. In such case, in excess of 92,000 display elements or pixels are required. For larger sets, of course, the number increases. The transistors used to drive the pixels are usually thin-film transistors (TFTs) deposited on a substrate such as glass. The display elements include electrodes deposited on the glass and common electrode elements on an opposing substrate, the opposing substrates being separated by an electro-optic material. On the substrate 14, which may be glass, the column data driver circuits 16 drive the column lines 24 with the video data signals. The row select driver 25 may be of any type well known in the art and sequentially activates the pixels in each selected row and the rows 1 through 240 are driven sequentially.

In the external control circuits 12 that are separate from the display 14, sample capacitors 50 receive data from input circuit 64 through shift register 49. The red, green and blue video signals are coupled from circuit 58 to the sample capacitors 50 in concert with the data in the shift registers 49. The clock signals and horizontal and vertical synchronization signals are provided by control logic 60. A high voltage generator 62 provides the necessary high voltage power. The output of the sample capacitors 50 are coupled to 64 output amplifiers 52. Thus, if one row of pixels includes 384 display elements, the 64 data input lines 13 are coupled in multiplexed fashion, 64 bits at a time, to the 384 display elements on the substrate 14. The 64 video outputs are coupled on line 13 to the column conductors 24 through column data drivers 16 as will be disclosed hereafter. On line 18, from control circuit 12, six pairs of video select signal lines are applied to the column data drivers 16 on glass 14 to demultiplex the 64 output signals and couple them sequentially to X (6) different groups of Y (64) columns 24 in a selected one of Z (240) rows on the glass 14. The row select driver signals, the clock and power lines are coupled from the control circuit 12 on line 21 to the row select driver circuit 25 as will be shown hereafter. Row select driver circuit 25 may be any of such type of circuits well known in the art. Precharge signals are coupled on line 48 to substrate 14.

Figure 4:
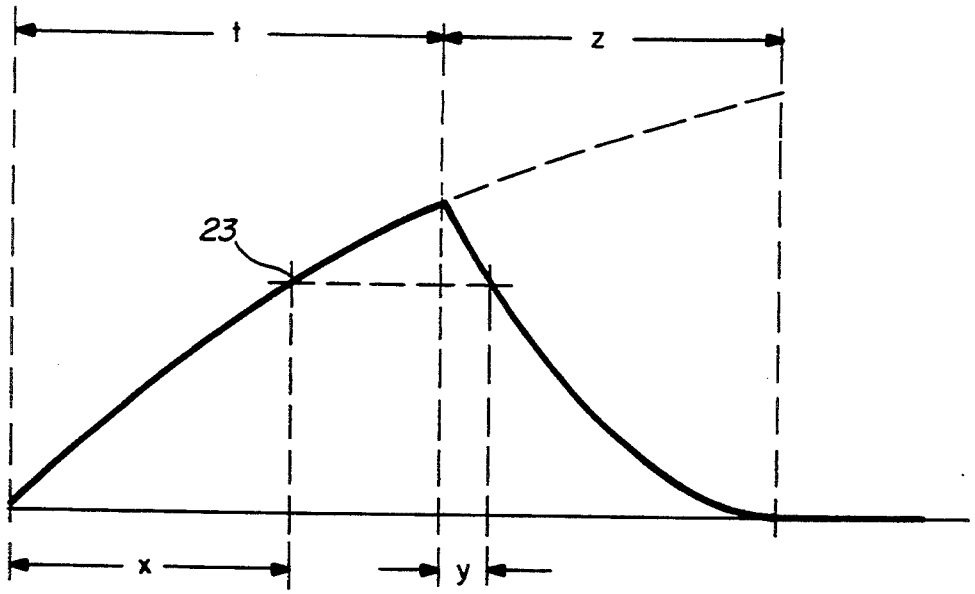
FIG. 4 is a diagram of a capacitor charge waveform illustrating that a capacitor discharges faster than it charges.

As will be shown hereafter, if the first row 26 is selected, the display elements 19, 36 and 42 in row 1, shown in FIG. 1, will all be activated. Then, in sequence, a precharging circuit in the column data driver circuit 16 will provide a signal that will charge each data line and each of the pixel capacitors 22 in the first group to a preselected voltage. Then, as the data signals are applied to the column lines 24, the capacitors will be discharged by an amount that depends upon the level of the data signal being applied to the column lines 24. The reason that a precharge circuit is used to enable the data signal to discharge the capacitors 22 is that they discharge much faster than they charge as illustrated in FIG. 4. As can be seen in FIG. 4, for the capacitor to charge from 0 to a value designated by the numeral 23, takes X amount of time. However, for the capacitor to discharge from its maximum value to that same level takes only Y amount of time which is much smaller than X. Further, it takes time, t, to charge to its full amount and a lesser time, Z, to discharge completely. Thus, the discharge times are much more rapid than the charge times thereby enabling the discharge of the data line capacitors to their proper voltage level during the data signal input time interval. This can shorten the time required for the data input time interval.

Thus, with each row sequentially energized, all of the pixel capacitors in all groups in a selected row are charged simultaneously to their full value and are discharged sequentially in X groups. Thus, X groups of Y switching transistors (19, 36, 42) in Z rows are deposited on the substrate 14. If the display should be, for example, a 384×240 pixel display, there could be six groups of 64 switching elements in 240 rows deposited on the substrate. Such example will be discussed herein.

Figure 2:
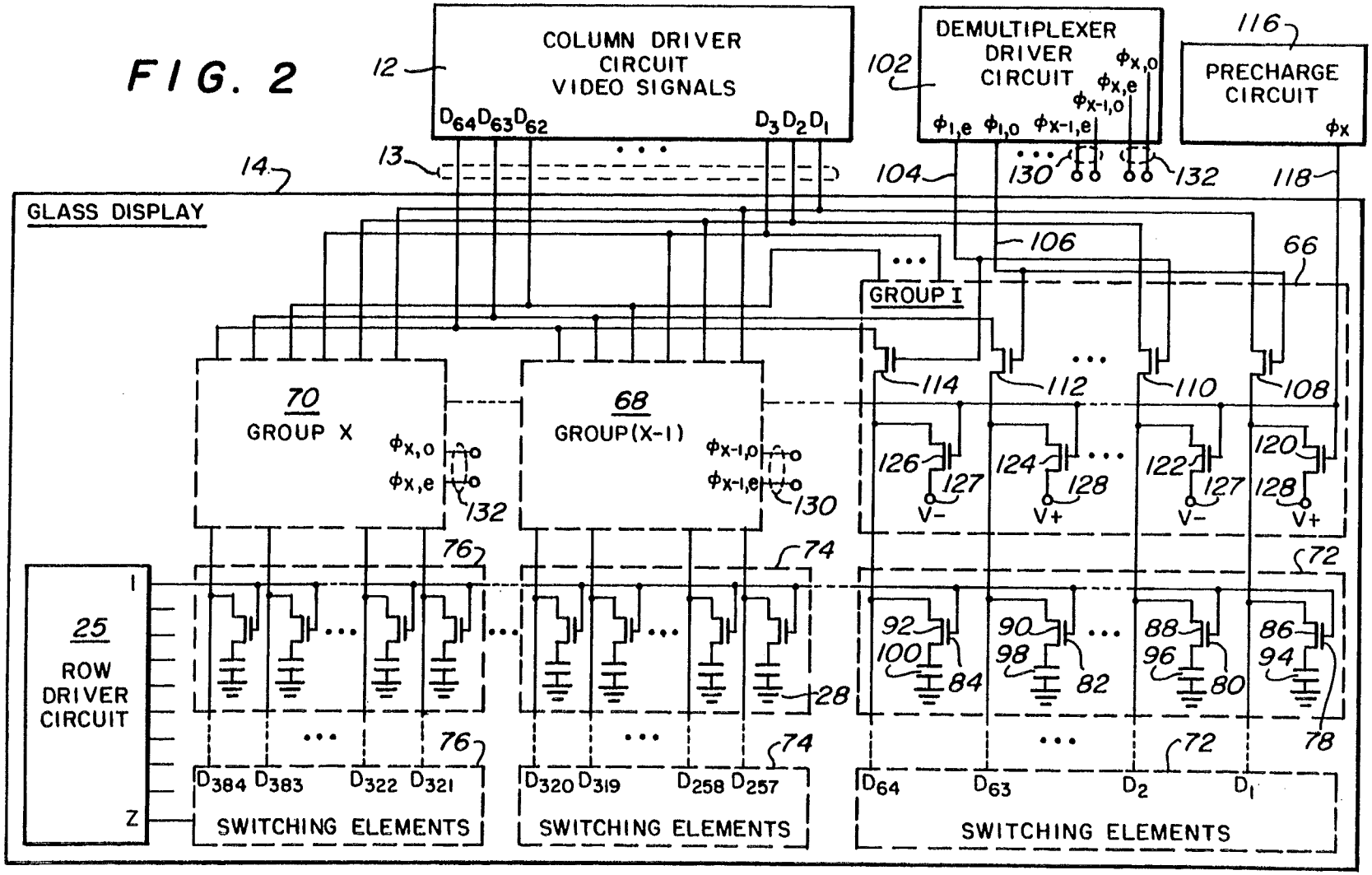
FIG. 2 is a detailed diagram of the matrix array and the data scanning circuits thereon.

FIG. 2 is a more detailed diagram of the substrate 14. Again, a column control circuit 12, external to the substrate, provides video signals on lines 13 to the substrate 14. Also, the row driver circuit 25, which is well known in the art and includes TFT transistors operated from the control signals on line 21 in FIG. 1 from the control circuit 12, sequentially selects a row as is well known in the art. Rows are indicated in FIG. 2 as 1–Z rows and only the first and last rows are shown. The remaining rows are identical. It will also be noted in FIG. 2 that there are X groups of Y switching elements. A switching element comprises a transistor and its associated pixel capacitor. In the first group designated by the numeral 72, there are shown only four switching elements 86, 88, 90 and 92 for purposes of simplicity. In actuality there would be 64 such switching elements if the X groups were six groups and the total number of columns used was 384 columns. The gates of the transistors 78, 80, 82 and 84, which may be thin-film transistors deposited on the glass substrate 14, are coupled through row conductor 1 to the row driver circuit 25. A pixel capacitor or display element (94, 96, 98 and 100) is connected to the respective source electrodes of the transistors 78, 80, 82 and 84. The electrode 28 is the second plate of the pixel capacitor and is the common electrode segment that is located on the opposing substrate of the display 14.

A precharge circuit 116 generates an output signal on line 118 that is coupled to the gates of all 384 precharge transistors, one of which is coupled to each of the 384 column lines on the substrate 14. A sample of the precharge transistors is shown in group 1, designated by the block numbered 66. Precharge transistor 120 has its drain connected to a voltage source, V+, and its source electrode coupled to internal data line column $D_1$. All of the odd column lines have such a transistor coupled thereto. For instance, in FIG. 2, transistors 120 and 124 have their drain electrodes coupled to a V+ voltage source 128. The transistors 122 and 126 for the even column lines have their drain electrodes connected to a V− voltage source 127. The 64 output lines $D_{1-64}$ from the column driver circuit 12, indicated by the numeral 13, contain the video signals that are coupled in parallel to each of the X groups. For the present example wherein the number of columns is set forth to be 384, there would be six groups (X=6) of 64 columns (Y=64) that receive the multiplexed video input signals from the input lines 13 in a demultiplexed fashion. Demultiplexer circuit 102 generates phase one and phase two pulses that are coupled to the gates of demultiplexing transistors 108, 110 . . . 112 and 114 in group one in block 66. Like signals on line pair 130 and line pair 132 from demultiplexer 102 drive groups five and six (X−1 and X) designated by the numerals 68 and 70. Thus demultiplexer driving circuit 102 first couples the 64 video data input lines 13 to the 64 columns in the first group 72 of switching elements 86 88 . . . 90 and 92, then sequentially couples the 64 lines to each of the successive groups 2 through X. Thus, the 64 data input lines 13 are sequentially coupled to the next five groups of switching elements including groups 74 and 76 as shown. Each of the rows 1 through Z are also sequentially selected where, in the example given, Z would be equal to 240 rows. One row is selected each time the 64 input data lines are sequentially coupled to all of the six groups 1–X.

Thus, in summary, FIG. 2 illustrates the block diagram arrangement of the integrated data driver circuit. It has a display which, for example only, provides a 384×240 pixel color hand-held TV. The horizontal pixel count is 384. The demultiplexer transistors 108, 110, 112, and 114 and precharge transistor 120, 122, 124, and 126 in each of the six groups 66, . . . 68, and 70, are fabricated with the thin-film transistors on the display itself to transfer video data from the input lines 13 and to interface the display directly to video signals on lines 13 from a video source. As shown in FIG. 2, the video signals from the video source (off-glass integrated circuits) are arranged to come onto the display 14 sixty-four data lines at a time through input data leads 13 ($D_{1-64}$) using one-sixth of a designated line time interval. The two control signals from the demultiplexing circuit 102 such as on lines 104 and 106 enable the first block of demultiplexing transistors 108, 110 . . . 112 and 114, in block 66 and transfer the video signals on line 13 to switching elements coupled to the display's first 64 internal data lines $D_1$–$D_{64}$. After completion of the transfer of the data to the first 64 column switching elements, the next 64 video signals will be transferred to the internal data lines $D_{65}$–$D_{128}$ during the next one-sixth of the designated line time interval. This is done by enabling a second pair of control signals for the second demultiplexing circuit (not shown). The same operation will continue sequentially for demultiplexing circuits in groups 3 through 6. The entire one row line of video information is thus transferred to the internal data lines in 42 microseconds of allocated data input time. Seven additional microseconds are allowed for pixel settling. Thus, the total data input time is 49 microseconds.

The advantage of this new demultiplexing driving scheme is to reduce the number of external lead connections from 384 to 79 and significantly solve the TFTLCDs' assembly and packaging problems of the small connector pitch. As a result, it reduces the manufacturing cost. In addition to the demultiplexing scheme using transistors such as 108, 110 . . . 112 and 114, a precharge transistor such as transistors 120, 122 . . . 124 and 126 are used to simultaneously precharge their associated data line and switching element to either a preselected voltage level V+ or V−, so that it requires discharge of the data lines to the preselected video signal level only during the data signal input time interval. One such precharge transistor is associated with each column line. With the invention as shown, it utilizes only two transistors on each data line, a demultiplexing transistor and a precharge transistor. Therefore, the circuit is easy to manufacture with good yield.

Figure 3:
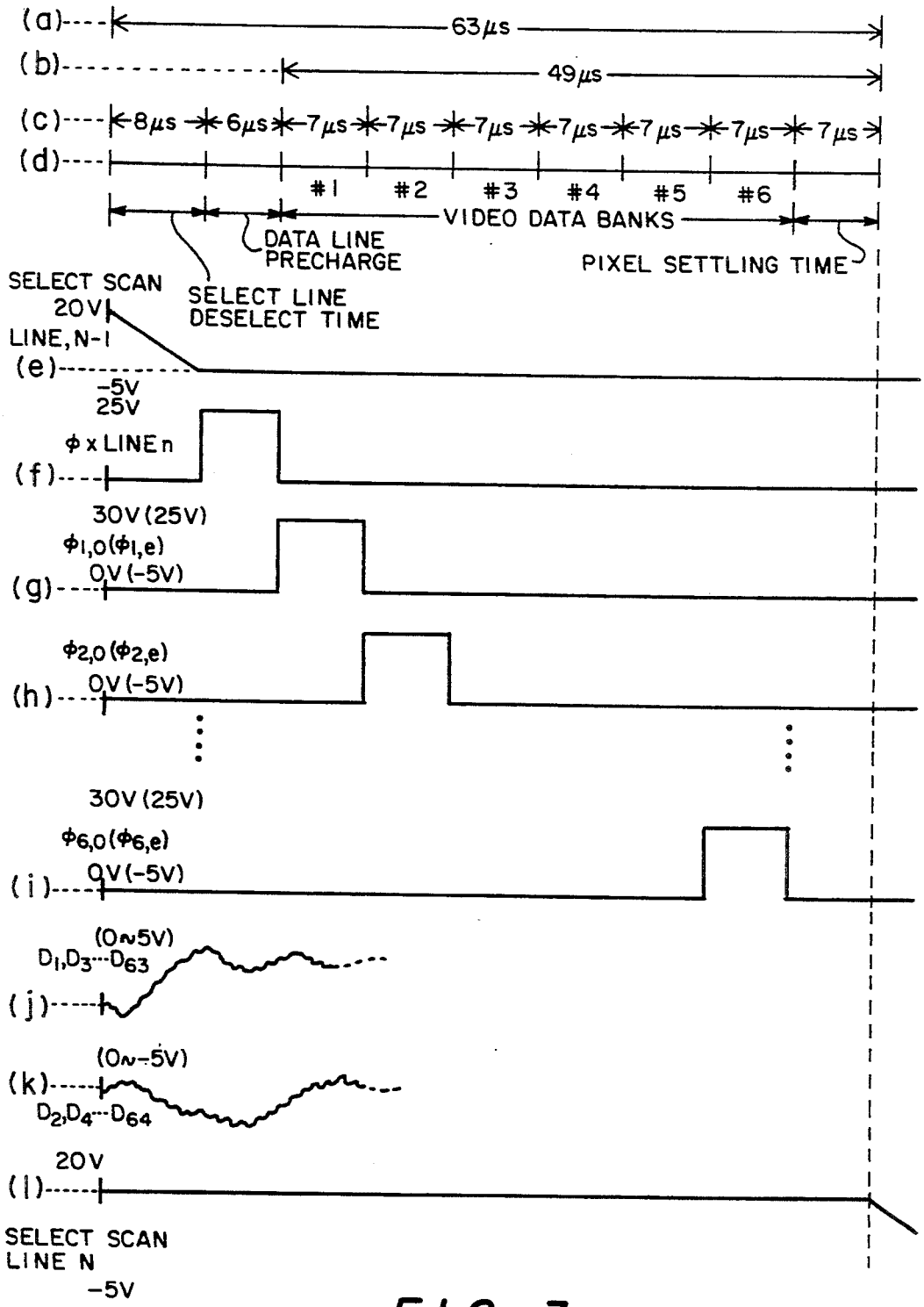
FIG. 3 illustrates the waveforms and timing of the present invention.
Figure 5:
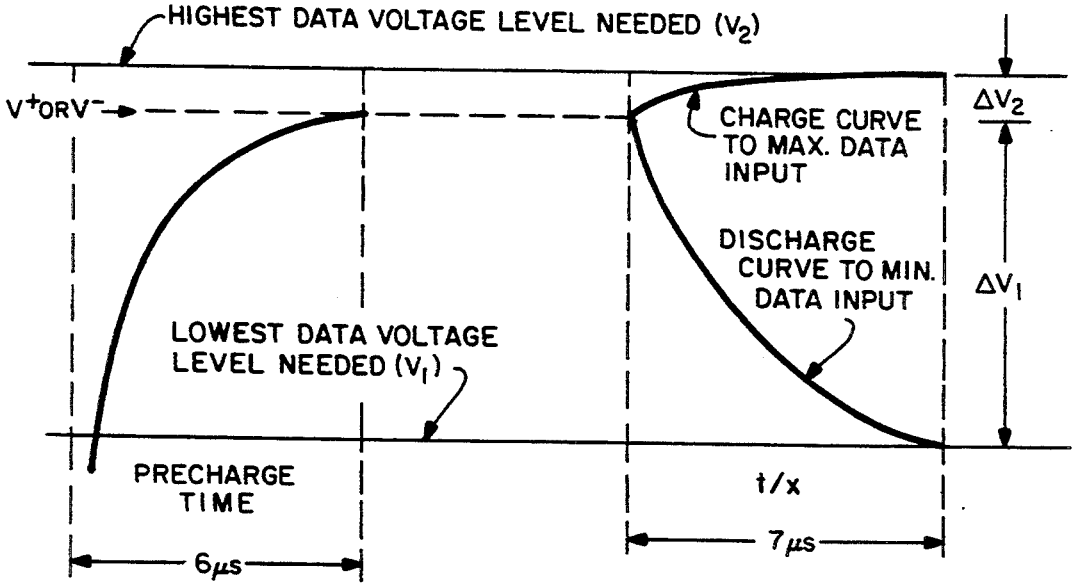
FIG. 5 is a waveform illustrating the time saving benefits of applying less than a full precharge voltage V+ or V− to the pixel capacitors.

Referring now to FIG. 2 in conjunction with the timing diagram in FIG. 3, it can be seen in line (a) of FIG. 3 that the scanning line time interval is approximately 63 microseconds for a 384×240 pixel display interfacing with the NTSC TV system. The budgeted line time is 8 microseconds for previous line deselection, 6 microseconds for scan data line precharge, 42 microseconds for the video data transferring in demultiplexed fashion from an external video source to the X groups of data lines of the display and 7 microseconds for the pixels to settle. This can be seen in line (c). Thus, reviewing line (d) of FIG. 3, it can be seen that during the first 8 microseconds of the deselect time, the previously scanned line, $1_{n-1}$, is discharged from a select level such as 20 volts to a negative 5 volts deselected level as shown in line (e) of FIG. 3. This isolates all pixel capacitors in line n−1 so that they hold their video data charge. Following the deselect time of 8 microseconds, the precharge signal for row n shown in line (f) rises to a preselected voltage such as 25 volts for 6 microseconds. The transistors 120, 122 124 and 126 are turned on such that the odd numbered internal data lines $D_1$, $D_3$, . . . $D_{383}$ are precharged to the V+ level and the even-numbered internal data lines $D_2$, $D_4$, . . . $D_{384}$ are precharged to V− level in 6 microseconds. The V+ voltage level is approximately 5 volts and the V− voltage level is approximately 0 volts, for example. It should be understood, however, that advantageously the V+ level may be something less than 5 volts to increase the speed of operation of the device. As can be seen in FIG. 5, during the precharge time period of 6 microseconds, the internal data line and the pixel capacitor may be charged to a V+ value that is less than the 5 volt maximum voltage. Then, during the 7 microsecond time period for the data lines to charge the pixel capacitors to the data input voltage level, it requires the same time for $\Delta V_2$ to go from V+ to the maximum data voltage and for $\Delta V_1$ to be discharged to the minimum data voltage. In both cases, the charge time for $\Delta V_2$ and discharge time for $\Delta V_1$ can be shortened or optimized. The data line and the pixel capacitor charge time has been reduced to the amount of time required to obtain $\Delta V_2$ and, if the required data line predetermined voltage is less than 5 volts, the discharge time to the required level is reduced by the amount of time equal to discharge $\Delta V_2$. In this manner, the V+ voltage level may be optimized so that the time difference between charging an internal data line and its associated pixel capacitor to the maximum input vido data signal level, 5 volts for example only, and discharging an internal data line and its associated pixel capacitor to the minimum input video data signal level, 0 volts for example, is minimal. Thus, less precharge time is required because the pixel capacitors are not charged to the full value of 5 volts during the precharge time period. The same analysis applies to the V− voltage level 127 as to the even precharge transistors 122 . . . 126. After all internal data lines and the pixel capacitors in a selected row such as 94, 96, . . . 98 and 100 are precharged to either V+ or V− levels, the incoming video data signals (red, green and blue) and their complementary signals are sent to the data input lines D1–D64. In this case, $D_1$, $D_3$, . . . $D_{63}$ are positive polarity video signals and $D_2$, $D_4$, . . . $D_{64}$ are their complementary polarity video signals. These video signal voltages are shown in lines (j) and (k) in FIG. 3. The control signals from demultiplexer driver circuit 102 on lines 104 and 106 are raised to 25 volts and 30 volts, respectively, as illustrated in line (g) in FIG. 3 for 7 microseconds. Each of the other X groups of input lines, in this case X=6, have the video data on lines 13 coupled thereto for 7 microseconds as shown in lines (g), (h) and (i) in FIG. 3. The reason to divide the data lines into two groups, even and odd, is because the data voltage polarity inversion scheme is used in this system. The data voltage polarity is altered between two fields of a TV frame. The last 7 microseconds of the 63 microsecond time interval is used to allow the pixels in the last group, group X, to settle.

The demultiplexing transistors 108, 110 . . . 112 and 114 are sized such that the internal data lines $D_1$–$D_{64}$ can be discharged to within 15 millivolts of the incoming video data color signal levels within the allocated time interval of 7 microseconds in this example. A successive operation is repeated for each of the demultiplexer circuits numbered 66 through 68 and 70, or all six groups.

At the beginning of the $n^{th}$ row line scanning operation, the pixel switching transistors in row n are already fully turned ON. Therefore, after the scanned row n−1 is deselected, the pixels in row n are then precharged. If the remaining 49 microsecond data input transfer time is allocated in essentially equal time periods of 8 microseconds each, the first block of the pixel transistors on columns $D_1$–$D_{64}$ in row n has the entire 49 microseconds for pixel discharge times, the second block of the pixel transistors in row n connected to columns $D_{65}$–$D_{128}$ has approximately 41 microseconds discharging time. The third block would have approximately 33 microseconds and so forth. The final block of the pixel transistors in row n would have substantially only 9 microseconds left for pixel discharging. By allocating 7 microseconds of time to each of the six groups of pixel transistors and allowing the final 7 microseconds for pixel settling as indicated in FIG. 3(*d*), sufficient time is allowed for all of the pixel transistors to discharge. Short discharging time might produce an error voltage ΔV for the sixth block of the pixels. In order to reduce the ΔV and have a resolution of 256 grey levels, it is desirable to allocate the additional 7 microseconds for pixel settling time. In this case, 14 microseconds will be available for the sixth group of pixel capacitors to settle to their video signal level. As line n−1 is being deselected as indicated in line (e), line n is being selected and the voltage applied to that line is at the maximum of 20 volts as indicated (l).

It is to be understood that the demultiplex ratio affects the number of video leads and the number of signal input leads. It can be optimized or compromised according to tile product application. For example, for high resolution and/or high picture quality, one can use a smaller demultiplex ratio so that more video signal leads per group could be coupled into the substrate 14 instead of 64. One can also reduce a large number of input lead counts for less demanding grade levels or slower speed video products.

Further, in the present application, the data lines and pixels are precharged to the highest needed voltage levels due to the fact that N-channel transistors are used for signal transferring and the data lines or pixels are discharged while inputting video signals because it is much easier and faster to discharge them than to charge them in order to obtain an accurate signal voltage.

Figure 6:
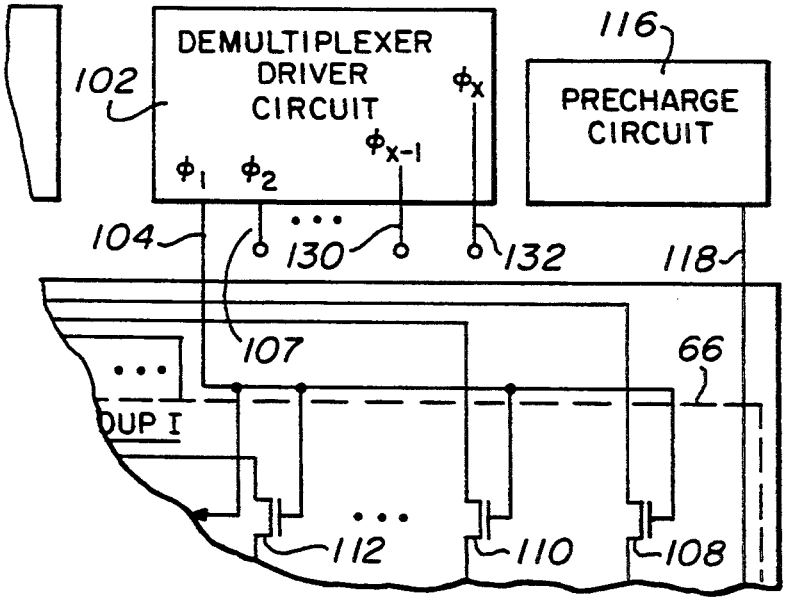
FIG. 6 is a partial section of FIG. 2 illustrating each of the X pair of the odd and even control lines combined into one control line with each one control line feeding the gates of all the multiplexing transistors in a receptive one of the X groups.

Further, $\Phi_{1,e}$ and $\Phi_{1,o}$ (lines 104 and 106) can be combined into one control line signal 104 feeding all the gates of multiplexing transistors 108, 110 . . . 112 and 114 in group 1 as shown in FIG. 6, a portion of FIG. 2 that has been modified. The combining of signals $\Phi_{1,e}$ and $\Phi_{1,o}$ into one control line 104 can be accomplished when the gate voltage stress is not a concern and the device characteristics of the demultiplexing transistors 108, 110 . . . 112 and 114 are good enough to discharge the internal data lines and pixel capacitors uniformly. In like manner, the other demultiplexing line pairs such as 130 and 132 to the other five groups, including 68 and 70 in FIG. 2, can be combined into one control line 107, 130, and 132, respectively, for each pair. In such case, the number of multiplexer gate control lines can be reduced to one-half the number.

Thus the present invention discloses an active matrix liquid crystal display in which the number of required data input leads are reduced and the column and row driver circuitry is integrated directly onto the display substrate. This reduces costs and increases reliability by eliminating the need for mounting integrated circuits on a separate substrate.

For the example given herein, a 384×240 pixel color hand-held TV is used. The horizontal pixel count is 384. The demultiplexer and precharge circuits are fabricated with thin-film transistors on the display itself to transfer video data and to interface the display directly to a video source. The video signals from a video source external to the display are arranged to come onto the display's 64 data lines at a time using one-sixth of a designated line time interval. Twelve control signals, two to each of the six groups, enable demultiplexing transistors in six different blocks to sequentially transfer the incoming video signals to the display's six groups of 64 internal data lines. After completion of the video data transfer to the first 64 internal data lines, $D_1$–$D_{64}$, the next 64 video signals will be transferred to the internal data lines $D_{65}$ through $D_{128}$. This is done by enabling the second set of control signals of the demultiplexing circuit. Each video data signal transfer takes place during one-sixth of the designated line time interval. This operation continues sequentially for all six demultiplexing circuits. The entire one row of video information is transferred to the internal data lines in 42 microseconds of allocated data input time.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A data line and pixel precharging circuit for driving a display having opposed first and second substrates, at least one of which is glass, separated by a thin layer of electro-optic material, the system comprising:

a plurality of switching elements deposited in rows and columns on the first substrate, each of the switching elements including a pixel capacitor and switching transistor forming a display element;

a common electrode for the pixel capacitors on the second substrate;

Y signal data input lines each having an input data voltage level;

a row driving circuit coupled to the row switching elements for sequentially selecting a given row and activating the switching elements in each of the sequentially selected rows 1–Z;

X groups of demultiplexing circuits deposited on the first substrate for sequentially coupling the Y signal data input lines directly to a selected X group of Y switching elements in each row 1–Z; and X groups of precharging elements deposited on the first substrate and directly coupled to corresponding ones of the switching elements for precharging each data line and pixel capacitor in a selected row to a predetermined DC voltage level such that the input data on the Y input data lines discharges the data lines and the selected pixel capacitors to the input data voltage level to form the display picture as each row is selected.

2. A pixel precharging circuit as in claim 1 further comprising:

a thin film transistor having source, drain, and gate electrodes forming each precharging element and having its source electrode coupled to one of its associated data lines;

a voltage source coupled to the drain electrode of each of the precharging transistors; and a precharging signal line coupled to the gate electrode of each of the precharging thin-film transistors to cause the transistors to conduct and precharge all data lines and the associated pixel capacitors in a selected row to said predetermined DC voltage level prior to the data on the Y input data lines being coupled to the switching elements so as to enable the data lines to discharge each pixel capacitor to the input data voltage level for forming the display picture.

3. A pixel precharging circuit as in claim 2 further comprising:

a first predetermined voltage coupled to the drain electrode of the precharging transistor coupled to odd input data lines $D_1$, $D_3$ . . . $D_{n-1}$; and a second different predetermined voltage coupled to the drain electrode of the precharging transistors coupled to even input data lines $D_2$, $D_4$ . . . $D_n$.

4. A system for reducing the number of data drive lines to a display device, the display device having first and second opposed substrates separated by a layer of electro-optic material, at least the first of the substrates being glass, and a plurality of internal data lines coupled to a like plurality of pixel capacitors deposited on the first substrate in X groups of Y columns in Z rows for generating a display picture when charged, the system comprising:

a first circuit for sequentially demultiplexing Y data input signal lines directly to all X groups of Y columns of internal data lines and pixel capacitors in a first fixed time period, t, and to each of the X groups of Y columns for a second fixed time period, t/X, to charge and discharge all internal data lines and selected pixels to the input data voltage level such that a third additional fixed period of time is available for enabling the selected pixel capacitors in the last of the X groups to have sufficient time to settle to the input data voltage level;

all of said pixel capacitors in row n−1 being isolated during a fourth fixed period; and a second circuit for precharging all internal data lines and pixel capacitors in row n to a first DC voltage level during a fifth fixed period of time, each successive row, n, of pixels being sequentially charged to the first DC voltage level and then changed to the input data voltage level with the demultiplexed data signals for the time periods indicated and with the pixels in each successive row, n−1, being isolated to form a display picture.

5. A method of reducing the number of data driving lines on a display having opposed first and second substrates, at least the first of which is glass, separated by a layer of electro-optic material and having a plurality of pixel capacitors deposited on the first substrate in X groups of Y columns in Z rows for generating a picture on the display when charged, the method comprising the steps of:

(a) sequentially demultiplexing Y signal data input lines directly to all X groups of Y columns of pixel capacitors in a selected one of Z rows in a fixed time period, t, and to each of the X groups of Y columns in a selected one of Z rows for a first fixed time period to cause each data line and its associated selected pixel to receive a preselected voltage level such that an additional second fixed time period is available for enabling the selected pixel capacitors in the last of the X groups to have sufficient time to settle to the preselected voltage level;

(b) isolating all pixel capacitors in row n−1 during a third fixed time period;

(c) precharging all pixel capacitors in row n to a predetermined first DC voltage level during a fourth fixed time period; and (d) repeating steps (a) through (c) for each of the Z rows in sequence to form a display picture.

6. A method of forming a pixel precharging circuit for driving a display having opposed first and second substrates, at least one of which is glass, separated by a thin layer of electro-optic material, the method comprising the steps of:

depositing a plurality of switching elements on the first substrate in X groups of Y columns in Z rows, each of the switching elements including a switching transistor and a pixel capacitor forming a display element;

forming a common electrode on the second substrate for the pixel capacitors;

forming Y signal data input lines on the first substrate;

coupling a row driving circuit to the switching elements for sequentially selecting a given row and activating the switching elements in each of the sequentially selected rows 1–Z;

depositing X groups of demultiplexing circuits on the first substrate for sequentially coupling the Y signal data input lines directly to the X groups of Y columns of switching elements in each row 1–Z; and depositing X groups of Y precharging elements on the first substrate that are coupled to corresponding ones of each of the Y switching elements in the selected X group for precharging each pixel capacitor in a selected row 1–Z to a first predetermined DC voltage such that the input data voltage level on the Y input signal data lines changes the voltage of each selected pixel capacitor to the input data voltage level to form the display picture as each row is selected.

7. A method for reducing input lines to a display of the type having opposed first and second substrates, at least one of which is glass, separated by a film of electro-optic material, the method comprising the steps of:

depositing X groups of Y columns of switching elements on the first substrate in Z rows for charging and discharging between a predetermined DC voltage level and an input data voltage level to create a display image;

depositing Y columns of signal data input lines on the first substrate;

depositing a demultiplexing circuit on the first substrate for sequentially coupling the Y columns of signal data input lines to corresponding ones of the Y columns of switching elements in each of the X groups; and coupling control means to the demultiplexing circuit for enabling the Y columns of signal data input lines to be sequentially and directly coupled to the X groups of switching elements over a fixed period of time, t, with the signal data lines being coupled sequentially to each of the X groups for a first time period, t/X, such that an additional time is allowed for the last group, X, of switching elements to settle from the predetermined DC voltage level to the input data voltage level.

8. A method of reducing the number of data driving lines to a display, the display having first and second opposed substrates separated by a layer of electro-optic material, at least the first of the substrates being glass, and a plurality of pixel capacitors deposited on the first substrate in X groups of Y columns in Z rows for generating a display picture when charged with data signals multiplexed on Y data input lines, the method comprising the steps of:

each of said X groups including Y columns of switching elements in each of said Z rows;

depositing a demultiplexing circuit on the first substrate for sequentially coupling the Y columns of signal data input lines to corresponding ones of the Y columns of switching elements in each of the X groups;

deselecting all pixel capacitors in row n−1 and selecting all pixel capacitors in row n with a first circuit during a first time period;

depositing a second circuit on the first substrate and comprising X groups of Y precharging elements;

coupling said X groups of Y precharging elements to corresponding ones of the switching elements for precharging each data line and pixel capacitor in a selected row to a predetermined DC voltage level with said second circuit during a second time period such that the signal data on the Y input signal data lines charges and discharges the selected pixel capacitors to the input data voltage level to form a display picture as each row is selected; and sequentially coupling the Y data input signals from the demultiplexer directly to each individual one of the X groups of Y columns of pixel capacitors for a time t/X in a third fixed time period, t, with a third circuit to vary the predetermined precharge DC voltage of selected pixel capacitors to an input data signal voltage level and to allow for an additional fourth period of time for enabling the selected pixel capacitors in the last of the X groups to have sufficient time to settle to the input data signal voltage level, each successive row, n, of pixels being sequentially and repetitively charged, each pixel having its predetermined DC precharged voltage changed to the input data signal level with the demultiplexed data signals and isolated in each successive row n−1 to form a display picture.

9. A data line and pixel precharging circuit for driving a display having opposed first and second substrates, at least one of which is glass, separated by a layer of electro-optic material, the system comprising:

a plurality of switching elements deposited in rows and columns on the first substrate, each of the switching elements including a pixel capacitor and a switching transistor forming a display element;

a common electrode for the pixel capacitors on the second substrate;

Y signal data input lines each having an input data voltage level;

a row driving circuit coupled to the row switching elements for sequentially selecting a given row and activating the switching elements in each of the sequentially selected rows;

X groups of Y precharging elements deposited on the first substrate and coupled to corresponding ones of the switching elements for precharging each data line and pixel capacitor in a selected row to a predetermined DC voltage level; and depositing a demultiplexing circuit on the first substrate for sequentially coupling the Y columns of signal data input lines to corresponding ones of the Y columns of switching elements in each of the X groups after said switching elements have been precharged such that the signal data on the Y input signal data lines charges and discharges the selected pixel capacitors to the input data voltage level to form the display picture as each row is selected.

10. A display of the type having opposed first and second substrates, at least the first of which is glass, separated by a layer of electro-optic material, the display comprising:

Y signal data input lines deposited on the first one of the substrates;

X groups of Y switching elements in Z rows deposited on the first one of the substrates;

a common electrode for all switching elements on the second substrate;

row drive lines coupled to the Z rows of the switching elements for activating the switching elements in each row;

a switching transistor and a respective capacitive pixel element forming each of the switching elements;

each capacitive pixel element having a first electrode deposited on the first substrate and a common electrode on the second substrate, each first electrode being coupled to a corresponding one of the Y switching transistors in each of the X groups of Y switching elements in one of Z rows;

X groups of Y demultiplexing elements deposited on the first one of the substrates and coupled to the X groups of Y switching elements and the Y signal data input lines for consecutively and sequentially coupling the signal data on the Y input lines directly to each of the X groups of Y switching elements for forming a picture; and X groups of Y precharging elements deposited on the first substrate, each being coupled to a respective one of the Y data lines in each of the X groups between the demultiplexing elements and the corresponding switching transistors to precharge the data lines and the pixel elements to a predetermined DC voltage level prior to data being applied to the signal data input lines.

11. A display as in claim 10 further comprising;

a thin-film transistor forming each demultiplexing element;

a first control line for each of the X demultiplexer groups deposited on the first substrate and respectively coupled to each even one of the demultiplexing elements for coupling the even signal data input lines to even ones of the switching transistors in a selected one of the Z rows in each of the X groups of switching elements as each one of the rows is sequentially activated; and second control lines for each of the X demultiplexer groups deposited on the first substrate and coupled to each odd one of the demultiplexing elements for coupling the odd signal data input lines to odd ones of the switching transistors in a selected one of the Z rows in each of the X groups of switching elements as each row is sequentially activated to create a display picture.

12. A display as in claim 11 further comprising:

a thin-film transistor forming each of the Y precharging elements in each of the X groups; and a thin-film transistor forming each of the Y switching transistors in each of the X groups of switching elements.

13. A display as in claim 12 wherein:

X=6 groups;

Y=64; and

Z=240.

14. A display as in claim 10 wherein the picture is a television picture.

15. A display as in claim 10 further comprising:

a thin film transistor forming each demultiplexing element; and a control line for each of the X demultiplexer groups deposited on the first substrate and respectively coupled to each one of the demultiplexing elements for coupling the signal data input lines to the switching transistor in a selected one of the Z rows in each of the X groups of switching elements as each one of the rows is sequentially activated.

* * * * *